United States Patent [19]

Nelson et al.

[11] Patent Number: 4,747,300

[45] Date of Patent: May 31, 1988

[54] SENSING PUMP WITH IMPROVED DISCRIMINATION BETWEEN LIQUIDS AND GASES

[75] Inventors: Robert E. Nelson, Rosamond, Calif.; Robert M. Nelson, Box 215, Rte. 1, Rosamond, Calif. 93560

[73] Assignee: Robert M. Nelson, Rosamond, Calif.

[21] Appl. No.: 899,928

[22] Filed: Aug. 25, 1986

[51] Int. Cl.[4] ..... G01N 7/00

[52] U.S. Cl. ..... 73/61 R; 137/391; 251/118

[58] Field of Search ..... 73/61 R, 61.1 R; 137/391; 251/118

[56] References Cited

U.S. PATENT DOCUMENTS

| | | | |
|---|---|---|---|
| 3,476,128 | 11/1969 | Barker | 251/118 X |
| 4,376,449 | 3/1983 | Nelson et al. | 137/391 |
| 4,496,287 | 1/1985 | Nelson et al. | 73/61 R X |

*Primary Examiner*—Stewart J. Levy
*Assistant Examiner*—Joseph W. Roskos
*Attorney, Agent, or Firm*—Donald D. Mon

[57] ABSTRACT

A sensing pump for discriminating between liquids and gases. The pump includes a plunger which is reciprocably moved by a succession of repetitive actuation of known force and time characteristics. The response of the plunger, acting against the fluid is indicative of the quality of the fluid (liquid, gas, or vapor). An orifice is provided in the system which in effect eliminates liquid viscosity as a determinant, and makes the system responsive instead to a mass-transfer regime. This increases the discriminatory capability of the system.

10 Claims, 2 Drawing Sheets

SENSING PUMP WITH IMPROVED DISCRIMINATION BETWEEN LIQUIDS AND GASES

FIELD OF THE INVENTION

This invention relates to sensors which provide information about fluids or the state of a fluid system as a function of opposition by the fluid to physical displacement of a displacement element, and to improvements that enhance their capacity to distinguish between liquids and gases over a wide range of environmental conditions.

BACKGROUND OF THE INVENTION

There are many sensors for measuring properties of fluids, and they vary widely in utility, sensitivity, ruggedness and reliability. It is a desirable objective to provide a rugged, simple and reliable sensor to respond to properties of fluids which are related to the opposition by the fluid to its own physical displacement. Examples of applications for such a sensor are determining the quality of a fluid, i.e., whether the fluid is all liquid, all gas, all vapor, or some mixture of them. Such information can, in turn, be used for information alone, or to control a system to restore the qualilty to some desired value. An example of a system utilizing this information is a control for the level of oil supply in an internal combustion engine. There are, of course, other applications for sensors which utilize different displacement resisting properties, for example viscosity, to determine some monitored condition of a fluid, for example the degree of dilution of oil by gasoline.

By sensing the opposition of a fluid to its own displacement, information can both be obtained and can be put to use to control systems which utilize the fluid for some other purpose. To this end, the sensor can also be used as a pump to cause the fluid to flow in a system for an advantageous purpose. One example of such an arrangement is the maintenance of a correct oil level in an internal combustion engine as discussed above. An additional advantage which can be secured is the incorporation of external oil reservoirs in the engine oil system which form part of the actively-used lubricant, rather than merely a static reserve. This extends the period between oil changes and the addition of oil, and enlarges the protection of oil systems from excessive dilution by engine fuel. These are important advantages when the engine is in a remote location, or one which is difficult to reach. Improving the reliability of an engine, and decreasing the frequency of routine service visits, can make appreciable cost savings possible.

There are many other uses to which the type of information derived by a sensor according to this invention can be employed for control purposes. It must be said that the applications for sensors according to this invention can be fulfilled by other types of sensors, which may or may not use the same physical property. However, many of the most useful applications of this sensor are in circumstances where ruggedness, simplicity, compactness, and reliablity are at a premium, and the sensor of this invention greatly excels many of the conventional sensors available as an alternate.

The range of possible fluid substances with which this invention may deal is limited generally to those which can be pumped or otherwise caused to flow in a fluid path or duct. Within this limitation it may deal with a broad range of possible fluids, which may consist of or contain gases or vapors, liquids, emulsions, mists and even suspended or entrained solids. Among fluids of the same composition there maybe variations in physical conditions such as temperature, pressure, viscosity, or vapor pressure, which it may be useful to identify. Variations in the state or quality of the fluid system which may affect opposition to fluid displacement may include differences in head or state of flow, or the presence or absence of a fluid at a particular point in the fluid system.

A substantial application for this invention is one wherein the sensor senses whether there is a liquid or a gas at the sensed location. In an oil lubrication system, for example, the sensing of gas can indicate that the oil level is too low. The sensing of liquid may indicate a sufficient or too high an oil level. Whatever the situation, the intended discrimination is between the presence of gas or of liquid.

However, the situation can become complicated at extreme conditions of operation, such as when an oil system is extremely cold. To provide optimum sensing, the system should be relieved from sensitivity to extremes of variables as much as possible.

BRIEF DESCRIPTION OF THE INVENTION

The sensor of this invention utilizes fluid-displacement means. The fluid displacement means includes a movable fluid displacement element whose motion is urged by the application of a known force and whose motion is accompanied by either an increase or a decrease in the volume of a region in the sensor which the fluid can occupy. The quality (gas or liquid, for example) of the fluid affects the resulting motion of the element, and the motion of the element is sensed by electrical means to derive information about the state of quality of the fluid.

In some adaptations of the invention, the space or volume available to the fluid during displacement may include not only that which is immediately adjacent to the displacement element but also that which is provided by paths of flow between the element and other parts of the fluid system. In still other adaptations the fluid momentarily may be isolated from the remainder of the fluid system in order to respond to the state or quality of the fluid independently of the operating state of the fluid system external to the means employed for fluid sensing.

When a fluid displacement element or portion of an element is subjected to an urging force in a fluid-displacing direction, a change in volume of the fluid may occur as a compression or expansion of the fluid if the fluid present is significantly compressible. Alternatively, flow may occur to or from the point of displacement by a path which, by its restriction, offers opposition to flow. Finally, displacement may be absorbed by a combination of compression or expansion and flow in a compensating path.

When displacement is urged at two points, one may choose to make either or both effective in restrictive oppositon to fluid displacement, by making either path or both paths limited in area of flow.

In the preferred embodiment utilizing a plunger in order to obtain the driving force required to urge the plunger into a fluid-displacing motion, the plunger is placed within a magnetic circuit that links a main or driving coil which is pulsed electrically to vary the magnetic flux of this circuit and thereby repetitively to vary a magnetic force applied to the plunger.

In the production of a fluid sensing signal responsive to the motion of the displacement element or plunger, it may be desirable to employ further electromagnetic means. Although such means could be independently provided, it is best to use a portion of the flux of the main magnetic circuit for this purpose, both because of the simplicity which this approach makes possible and because of the convenience which it offers in coordinating in time the activating or driving pulses with the production of fluid sensing signals.

In a preferred but optional construction, a portion of the flux of the main magnetic circuit links a sensing coil variably according to the position of the plunger. In this construction, there is obtained a sharp transfer of flux as the plunger advances, and produces in the sensing coil a strongly induced signal. In one variation of this construction, the advance of the plunger more strongly links the sensing coil to the main magnetic circuit to give a rising-flux induced voltage or EMF in this coil. In another variation, linking diminishes during plunger advance to give a falling-flux induced voltage or EMF. In either case the induced EMF constitutes a sensing signal which varies in intensity and in timing with the varying motion of the plunger and therefore with the opposition of the fluid.

An important object of this invention is the provision of means for differentiating among varying fluid sensing signals, whereby signal characteristics may indicate the varying response of the fluid displacement element to the urging force as determined by the opposition of the fluid. Characteristics of the sensing signal useful for this purpose may include peak strength or magnitude, and timing, as determined by the attainment of a predetermined level, intensity or polarity, or rate of rise or fall. Such characteristics may be useful in the interpretation of signals read by such means as an oscilloscope. They also provide a basis for signal interpretation by electronic means which may resolve the signal into a form useful for information and for the control of further system functions.

An important area of application of this invention is that of discrimination between a gas or vapor, and a liquid. One may choose to produce by electronic discriminator means an output signal adapted to activate a further system function when the sensing is of a gas or vapor but not of a liquid. Instead one may choose to make the output signal responsive to the presence of a liquid but not to a gas or vapor. It is likewise possible to discriminate between fluids of which neither is a gas or vapor, and to produce an output signal responsive to the presence of either. Output signals may be bi-level in response, indicating merely the presence or absence of a condition of fluid opposition, or they may be ranging in response, indicating by degree the condition of opposition. One may express such an output by way of an analog voltage or of its digital equivalent. More than one output may be provided simultaneously.

Sensors and systems useful for the above general purposes are shown in Nelson el at U.S. Pat. Nos. 4,376,449 and 4,496,287. Both of these patents are incorporated herein by reference, in their entirety, for their showing of suitable sensors, actuating and responsive circuitry, and uses for this system. Further, their properties illustrate the advantages of sensors which can make a sharp discrimination between gases and liquids.

This instant invention utilizes in series with the volume that is being varied by the plunger, one or more orifices whose regime is to provide response to pressure dynamic flow. Its dimensions are such that it eliminates viscosity as a primary determinant. It permits of generous mass flow. Its reaction to this is prompt enough that even at low temperatures, heavier oils, and mixtures of air and liquid (foam), will go through quickly enough not to confuse a sensor which is also adapted to sense a pulse of gas.

The above and other features of this invention will be fully understood from the following detailed description and the accompanying drawings which:

DESCRIPTION OF THE INVENTION

FIG. 1 is an axial cross-section showing the preferred sensing pump and system according to the invention; and FIG. 2 is a graph illustrating the advantages of the invention.

DETAILED DESCRIPTION OF THE INVENTION

Figure 1:
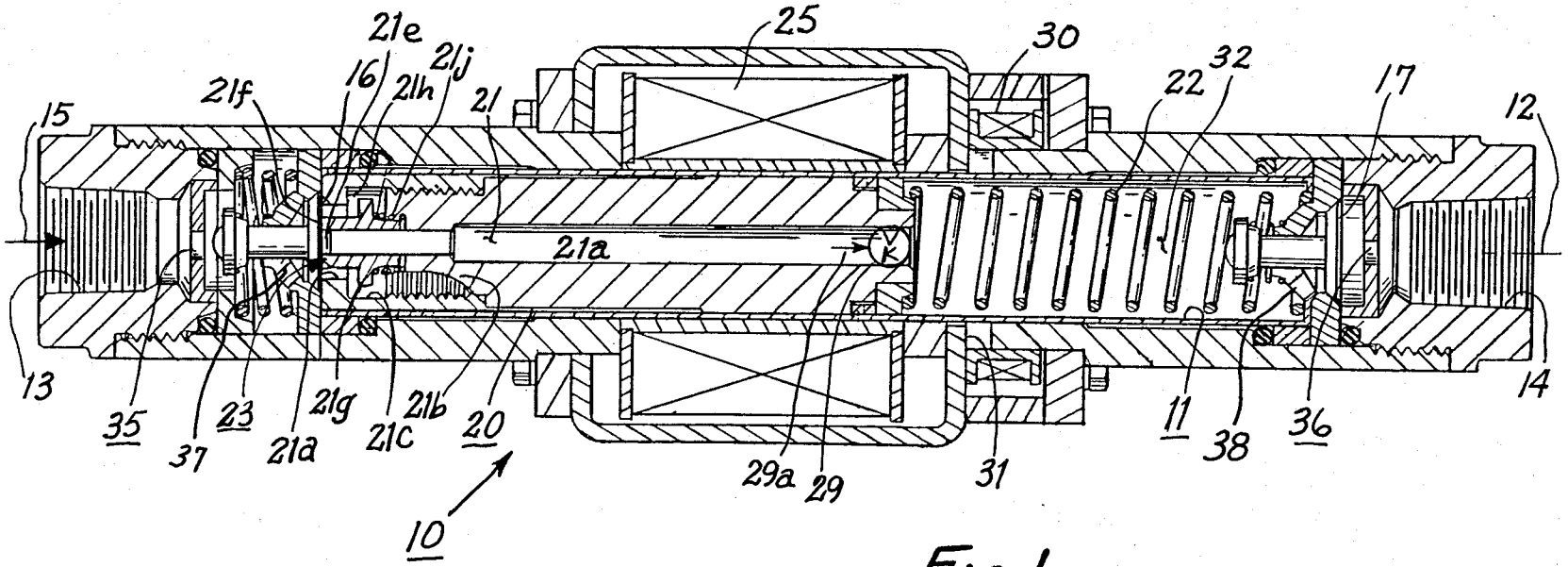

The presently preferred sensing pump 10 for use with this invention is shown in FIG. 1. This will be recognized as the device of FIG. 1-1 in U.S. Pat. No. 4,376,449. Because its construction and operation are fully disclosed in that patent, it will not be repeated here. The reader is referred to that patent for full details. Instead, only those portions which are most specifically related to this invention will be described here.

Sensing pump 10 has a body with an inner cylindrical bore 11 that extends along an axis 12. An inlet port 13 is at one end of the body, and an outlet port 14 is at its other end. The forward direction of flow is shown by arrow 15, from tbe inlet port to the outlet port. The ports may be considered as part of circuitry which leads to a system in which fluid to be sensed is present. The conduitry leads to the bore.

An inlet check valve 16 is disposed between the inlet port and the bore, and an outlet check valve 17 is disposed between the bore and the outlet port. Their direction of permitted flow is that of arrow 15. They close to prevent flow in the opposite direction, and are spring loaded for that purpose. This assembly when operated, pumps the fluid through the bore.

A plunger 20 is externally cylindrical and has a length that is shorter than the bore. It has an outer diameter proportioned such that the plunger can freely slide in the bore. A bypass passage 21 extends from end-to-end of the plunger. The plunger is spring biased toward the inlet end by a bias spring 22. By-pass passage 21 includes a passage **21*a*, a port 21*b*, a valve chamber 21*c* and a passage 21*d*, which are interconnected as shown. A pin 21*e* fitted in the plunger closes one end of central passage 21*a* and slidingly supports a valve member 21*f* that has a shoulder 21*g* adapted to abut valve seat 21*h*. Valve seat 21*h* faces into the valve chamber. A bias spring 21*j* biases the valve member toward the valve seat. Valve 23 is formed by the valve member and valve seat. It is briefly held open as shown at the start of a cycle to assist in clearing the passages. Valve 23 acts as a check valve which permits by-pass flow only from the exit end to the intake end of the bore, i.e., from right to left in FIG. 1**, enabling fluid transfer which permits the plunger to return to the left, but except at the first brief moment at the start of actuation does not by-pass fluid in the opposite direction during the forward motion of the plunger.

When the plunger is impelled to the right in FIG. 1, and moves away from the inlet check valve, the bias spring force of spring 21*j* will close the by-pass passage, and there will be no flow past the plunger during this "forward" movement. When the actuation ceases, and bias spring 22 returns in its return motion, inlet check valve 16 will be closed, and the resulting fluid pressure will unseat the valve member, and fluid can flow through passage 21*d*, valve chamber 21*c*, port 21*b* and passage 21*a* to the exit end of the bore. This conduitry acts as a by-pass passage. By-pass of fluid during the return movement is provided It is not provided during the forward movement of the plunger. Another check valve 29 may be placed at the forward end of the by-pass passage in addition to, or instead of valve 23. Its permitted direction of flow is shown by arrow 29*a*. Its flow permitting and flow checking properties are the same as those described for valve 23, except at the moment of start, when it is closed, and valve 23 is momentarily open.

The structure recited to this point except for the plunger is made of non-magnetic material.

An actuating coil 25 is disposed to energize a magnetic circuit which includes plunger 20 which starts in a position to the left in FIG. 1. Energizing this coil will accelerate the plunger toward the right in FIG. 1, namely toward the outlet port. A pulse of current of known shape and intensity in the coil will produce a repeatable and known force on the plunger.

A sensing coil 30 surrounds the body, spaced away from the actuating coil. An air gap 31 is provided for purposes disclosed in the referenced patent. It will be evident from the foregoing and from the patent that when the actuating coil is energized, the plunger will be accelerated to the right, and that its motion will be sensed by sensing coil 30 which will give rise to a current that can be utilized for data purposes described in the patent. Because the actuating force is repetitive and known, the resistance to movement of the plunger will be a function of the condition and quality of the fluid in portion 32 of the bore ahead of the plunger.

The specific improvement of this invention comprises orifices 35 and 36 provided in plates adjacent to the inlet port and the outlet port respectively. In some instances, it will be useful to provide both of these orifices, but instead either one can be used without the other. Generally, when only one is used, it will preferably be on the outlet side such as orifice 36. The purpose and relative dimensions of these orifices will now be described.

Instead of being disposed in separate plates as shown, the orifices could instead be formed as part of a respective valve. For example, ports 37 and 38 in valves 16 and 17 could be appropriately sized for this purpose.

As is fully developed in the referenced patents, signals from a sensing pump may be employed simply for information and can be read by any convenient means such as an osciloscope, or can be used to activate a desired function such as a second pump in a two pump system, using circuit discriminator means. Discrimination, for example, to determine whether a pump should be operated or not may be based upon signal strength in which the function is activated by a signal which exceeds a predetermined level, or by signal timing by which activation is limited to the open period of timed gating means, or by a combination of both, in which a signal to cause activation must be both early enough and of sufficient magnitude.

Figure 2:
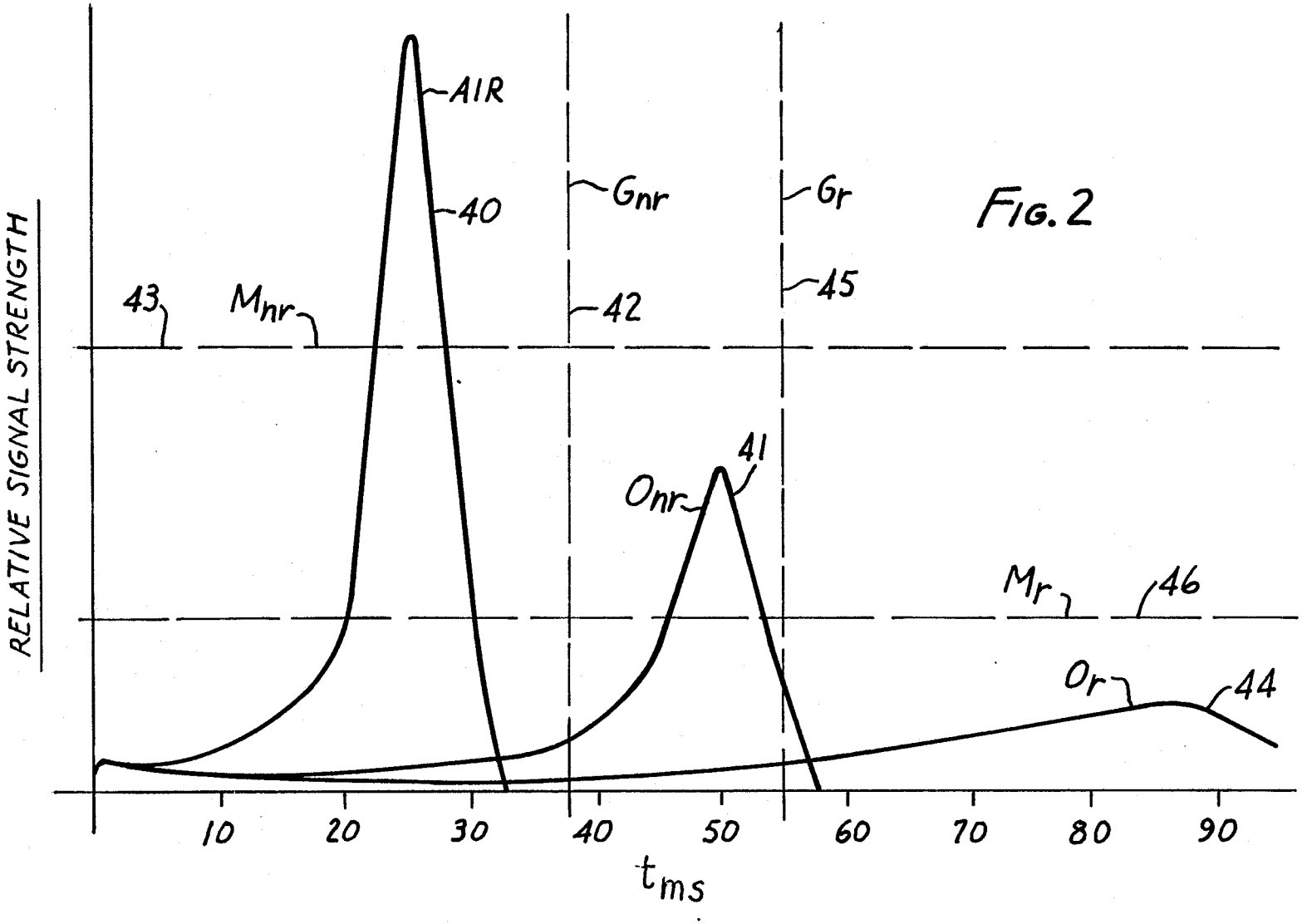

It should be kept in mind that the purpose of this system is to discriminate between a liquid in the bore and a gas or vapor or mixture of the two. As a consequence of this information, suitable response may be taken. It is evident that in pumping the device of FIG. 1 with or without the orifices 35 or 36, the reaction of the plunger will be different for oil than for air, and that for best discrimination, it is best practice to have as much separation both in magnitude and in timing between the two as possible. FIG. 2 graphically shows these circumstances plotting relative signal strength versus time in milliseconds, the time beginning with the energizing of coil 25.

Initially, it will be noted that when the pump is delivering air, the curve 40 will be substantially the same whether either, or both of the orifices 35 and 36 are provided, or if none is provided, because the use of an orifice size suitable for a control of oil signals offers negligible resistance to the flow of air or vapor. This curve 40 for convenience is also marked "air".

When the pump is operating with an oil of low viscosity without orifices 35 or 36, a typical signal would be that of curve 41 which is marked ONR meaning oil no restriction. It will be noted that this signal occurs at a later time and is of a lower strength than an air signal. Normally, it is not difficult to discriminate between air and oil signals on the basis of time or of magnitude.

If a gate remains open only to a time shown by line 42 marked GNR (gate no restrictor-orifice), and there is no orifice in the line, and that time follows an air signal but preceeds an oil signal, only an air signal could trigger discrimator means based on this time relationship. Similarly, if discrimination is on the basis of magnitude of either signal, a required trigger level such as shown by line 43 and marked MNR (magnitude no restrictor—orifice) which is below the peak value of an air signal but above the value of a normal oil signal, than this would permit triggering by an air signal only.

In a pump without an orifice, extreme conditions of operation may affect discrimination and system performance. Under cold conditions, the residual oil within the bore is usually high in viscosity and causes substantial drag on the plunger. This has the effect of making the air signal arrive later and weaker. Unless the discriminator has a substantial tolerance for weaker air signals, such signals might be excluded either by the gate block of line 42 or by the magnitude requirement of line 43, and the response to an air condition would be poor. Conversely, an early, strong oil signal might fall within the triggering limits and give a false reponse. This could happen, for example, if the supply voltage had for any reason become abnormally high. Unless normal air and oil signals can be widely separated, there may be insufficient room between them for reliable discrimination under extreme conditions.

Increased separation of normal air and oil signals is the primary purpose of the orifice restrictors 35 and 36. In tests, when only orifice 36 was used, the signal represented by line 44 marked OR (oil restrictor) was obtained. Note there is a later peaking and a lower magnitude of the signal and it can be attributed to the retarding effect of the orifice upon the movement of the plunger when pumping oil. With the normal oil signal occuring later than before, it is now possible to determine the allowable position of the gate to a later time shown by line 45 and further indicated by GR (gate with restrictor) and a trigger line to a lower level indicated by line 46 and further marked MR (magnitude with restrictor). Further testing has shown a greater tolerance for weak air signals and a corresponding rejection of abnormally strong oil signals resulting from a deliberately applied over voltage to the sensing pump.

In the test as described, a light oil of low viscosity was used. More viscous oils are slower in delivery, particularly at low temperatures, with or without an orifice, because of pressure drop within the pump and its connecting lines. At the same time, the velocity of flow through the orifice becomes lower and the retarding effect attributable to the orifice pressure drop is diminished. The effect of the increased viscosity is thus partially compensated.

Suitable dimensions for sensing pump 10, and which resulted in the curve shown has a plunger diameter of 0.710 inch. The diameter of the downstream orifice 36 was 0.093 inches. The appropriate orifice for individual applications or variations in pump design will normally be found by trial. Experiments have been carried out with the orifice in other positions than those shown in the drawings. Other positions possible are the upstream positions shown by orifice 35 within the pump, upstream at a distance along the supply conduitry, and along the exit conduitry at a distance downstream from the pump. Although an orifice restrictor in each of these positions had effect, none of them was judged better than an orifice placed in the position shown for orifice 36.

Equivalent methods for introducing the orifice in the line may be used, such as combining the orifice with the valve body or other structural elements or placing an orifice restriction in an outgoing hose adapter. Various equivalents to the single orifice may be applied, such as placing two or more orifices in series or parallel connection. A single orifice placed in the location of orifice 36 remains the preferred choice. The orifice may also be used with any of the other embodiments shown for a sensing pump in the referenced patents. Some have only a single inlet port that is also used for exhaust, but the theory and use of the orifice remains the same. The selection shown in FIG. 1 of this application is the preferred embodiment and the one which lends itself best to an understanding of the invention.

The proportions used throughout this system are such that they are large enough to permit viscous flow at low temperatures and not to be a serious impediment to the flow. This invention utilizes an orifice whose discriminating function is not basically viscosity but instead is the discharge capacity of mass flow. Viscosity is basically eliminated from the sensing considerations and the rate of mass transfer through an orifice is used instead.

As clearly shown in FIG. 2, there is a substantial difference both in the magnitude and in the time spacing of the peaks of the air and oil signals, especially as compared with the curve 41 when no restrictor is used. Thus, this invention makes more reliable the operation of devices which rely on discrimination between air and oil signals over much broader environmental conditions.

This invention is not to be limited by the embodiments shown in the drawings and described in the description which are given by way of example and not of limitation, but only in accordance with the scope of the appended claims.

I claim:

1. In a sensing system which receives and samples a fluid to determine by discrimination response the quality of the fluid in the sense of its being a liquid, a gas, or a mixture of liquid and gas, said system including a sensing pump having a body with a bore, an axis, an axially movable magnetically responsive plunger in said bore adapted for movement in a forward and in a return direction, passage means and valving means enabling transfer of said fluid past said plunger during plunger motion in the return direction, actuating coil means surrounding said plunger adapted to exert a known and repeatable axial force on said plunger, a sensing coil responsive to movement of said plunger to provide a signal proportional to the rate of displacement of the plunger, at least one port through said body and first conduitry in communication with said port, the improvement comprising a restrictor orifice in the path of fluid flow into or out of said bore so proportioned as to establish, through it, the regime of flow of liquid as that of mass transfer rather than of viscosity.

2. Apparatus according to claim 1 in which a pair of said ports is provided, one being an inlet port and the other being an outlet port, each entering the bore at a respective end of the plunger, in which said first conduitry communicates between said inlet port and a source of fluid to be sensed, and in which second conduitry exhausts the fluid from the outlet port.

3. Apparatus according to claim 2 in which said orifice is disposed in said second conduitry.

4. Apparatus according to claim 3 in which said orifice is disposed adjacent to said outlet port.

5. Apparatus according to claim 4 in which said bore includes a pair of check valves, and in which said orifice is between one of said check valves and one of said ports.

6. Apparatus according to claim 2 in which said orifice is disposed in said first conduitry.

7. Apparatus according to claim 2 in which a said orifice is disposed in both said first and second conduitry.

8. Apparatus according to claim 1 in which an inlet check valve and an outlet check valve are provided in the bore; each communicating with a respective opposite end of the plunger, each check valve permitting flow in the direction from inlet to outlet and preventing flow in the opposite direction.

9. Apparatus according to claim 8 in which said orifice is provided as part of one of said check valves.

10. Apparatus according to claim 8 in which an additional check valve is provided in said passage means, enabling flow therethrough only in the direction from the end of the passage means nearer to the outlet, and preventing flow in the other direction at least during the major portion of the forward movement of the plunger.

* * * * *